US008557085B1

(12) United States Patent
Tonello

(10) Patent No.: US 8,557,085 B1
(45) Date of Patent: Oct. 15, 2013

(54) DRYER APPARATUS FOR DRYING A WEB

(75) Inventor: Fabrizio Tonello, Cervasca (IT)

(73) Assignee: PMT Italia S.p.A., Pinerolo (Torino) (IT)

( * ) Notice: Subject to any disclaimer, the term of this patent is extended or adjusted under 35 U.S.C. 154(b) by 0 days.

(21) Appl. No.: 13/507,578

(22) Filed: Jul. 10, 2012

(51) Int. Cl.
*D21F 5/00* (2006.01)

(52) U.S. Cl.
USPC ..... 162/290; 162/358.3

(58) Field of Classification Search
USPC ..... 162/290, 274, 275, 358.3, 359.1
See application file for complete search history.

(56) References Cited

U.S. PATENT DOCUMENTS 6,780,282 B2 * 8/2004 Scherb et al. ..... 162/111
6,790,315 B2 * 9/2004 Klerelid ..... 162/117
6,841,037 B2 * 1/2005 Scherb et al. ..... 162/109
7,691,230 B2 * 4/2010 Scherb et al. ..... 162/116
7,850,820 B2 * 12/2010 Scherb et al. ..... 162/117
2002/0060042 A1 * 5/2002 Klerelid et al. ..... 162/358.1
2010/0059192 A1 * 3/2010 Scherb ..... 162/263
2011/0139391 A1 * 6/2011 Anema et al. ..... 162/358.3
2011/0180223 A1 * 7/2011 Klerelid et al. ..... 162/111

* cited by examiner

*Primary Examiner* — Mark Halpern
(74) *Attorney, Agent, or Firm* — David J. Archer

(57) ABSTRACT

In a papermaking machine, a dryer apparatus for drying a web. The dryer apparatus includes a drying cylinder and an upstream roll cooperating with a peripheral surface of the drying cylinder. A looped felt extends around the upstream roll and is guided by the upstream roll so that the looped felt and the peripheral surface of the drying cylinder define therebetween a nip for the passage therethrough of the web. The looped felt moves away from the peripheral surface of the drying cylinder downstream relative to the nip such that the web inherently follows and is supported by the peripheral surface of the drying cylinder downstream relative to the nip. A shoe press is disposed downstream relative to the nip, the shoe press including a looped press felt and a shoe which cooperates with the peripheral surface of the drying cylinder downstream relative to the nip.

18 Claims, 4 Drawing Sheets

DRYER APPARATUS FOR DRYING A WEB

BACKGROUND OF THE INVENTION

1. Field of the Invention

The present invention relates to, a dryer apparatus for drying a web.

More specifically, the present invention relates to, a dryer apparatus for drying tissue.

2. Background Information

In the papermaking industry, a paper making machine ejects paper pulp onto a moving drainage screen so that water is permitted to drain from the formed web. In the case of a tissue machine, the formed web is removed from the drainage screen by a pick-up roll so that the web can be guided and supported by a felt. The felt guides the web of tissue onto the heated outer surface a rotating Yankee dryer. In recent years it has been discovered that large amounts of water can be pressed from the web by an extended nip press or shoe press which cooperates with the heated surface of the Yankee dryer.

However, because the felt supporting the web has been in contact with the web from the forming section, there is a tendency for such felt to have absorbed a considerable quantity of water from the web prior to passage of the web supported by the felt extending through the extended nip. Accordingly, because the extended nip removes a relatively large amount of water from the web, the water absorbing capacity of the felt is not in an optimum water absorbing condition when such felt enters the extended nip.

The present invention completely overcomes the aforementioned problem of the water absorbing capacity of the felt by the provision of a separate press felt which only extends through the extended nip and is therefore in an optimum condition for absorbing the relatively large quantities of water removed from the web during passage thereof through the extended nip.

Therefore, it is a primary feature of the present invention to provide a dryer apparatus for removing water from a web of tissue that overcomes the problems associated with the prior art arrangements.

Another feature of the present invention is the provision of a dryer apparatus that enables the removal of relatively large quantities of water from a web of tissue as the web moves through an extended nip cooperating with a heated surface of a Yankee dryer A further feature of the present invention is the provision of a dryer apparatus that enables a press felt to extend through an extended nip with an optimum water absorbing capacity.

Other features and advantages of the present invention will be readily apparent to those skilled in the art by a consideration of the detailed description of a preferred embodiment of the present invention contained herein.

SUMMARY OF THE INVENTION

The present invention relates to a dryer apparatus of a papermaking machine. The dryer apparatus includes a drying cylinder which is rotatable about a rotational axis, the drying cylinder defining a peripheral surface for supporting and drying the web. An upstream roll cooperates with the peripheral surface of the drying cylinder, the upstream roll being rotatable about an axis of rotation, the axis of rotation being disposed spaced and parallel relative to the rotational axis of the drying cylinder. A looped felt extends around the upstream roll and is guided by the upstream roll so that the looped felt and the peripheral surface of the drying cylinder define therebetween a nip for the passage therethrough of the web. The looped felt moves away from the peripheral surface of the drying cylinder downstream relative to the nip such that the web inherently follows and is supported by the peripheral surface of the drying cylinder downstream relative to the nip. A shoe press is disposed downstream relative to the nip, the shoe press including a shoe which cooperates with the peripheral surface of the drying cylinder downstream relative to the nip. The arrangement is such that the shoe and the peripheral surface of the drying cylinder define therebetween an extended nip for the passage therethrough of the web supported and guided by the peripheral surface of the drying cylinder. A looped press felt extends through the extended nip such that the web is disposed between the press felt and the peripheral surface of the drying cylinder during passage of the web through the extended nip.

In a more specific embodiment of the present invention, the drying cylinder is a Yankee dryer.

In another embodiment of the present invention, the drying cylinder is a through dryer.

The peripheral surface is a heated smooth surface. However, in the through dryer embodiment of the present invention, the peripheral surface defines a plurality of perforations.

Moreover, the upstream roll is a suction roll and the looped felt guides the web to and around the upstream roll.

Furthermore, the heated peripheral surface guides and supports the web during movement of the web from the nip to the extended nip.

Also, the shoe is a hydrodynamic shoe.

However, in an alternative embodiment of the present invention, the shoe is a hydrostatic shoe.

Additionally, the shoe press further includes a blanket which slidably cooperates with the shoe for supporting and guiding the press felt during passage thereof through the extended nip.

In a preferred embodiment of the present invention, the blanket is an enclosed blanket for enclosing the shoe.

Also, the shoe press further includes a plurality of guide rolls for guiding the looped press felt.

At least one of the guide rolls is movable so that tensioning of the press felt is permitted.

Also, an automatic press felt guiding device cooperates with at least one of the guide rolls so that the press felt is guided during running of the press felt.

Additionally, at least one of the guide rolls is a driven roll so that the press felt loop is driven when the shoe is disposed in an open nip condition.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views and embodiments of the drawings.

DETAILED DESCRIPTION OF THE DRAWINGS

Figure 1:
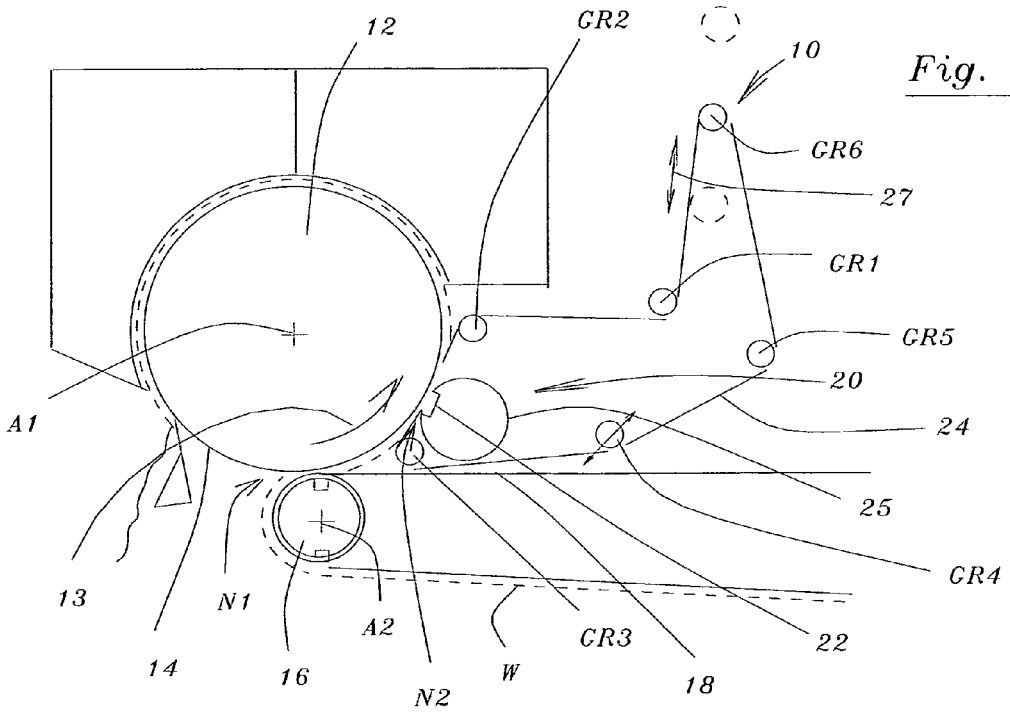
FIG. 1 is a side elevational view of a dryer apparatus of a papermaking machine according to the present invention.

FIG. 1 is a side elevational view of a dryer apparatus generally designated 10 of a papermaking machine for drying a web W according to the present invention. As shown in FIG. 1, the dryer apparatus 10 includes a drying cylinder 12 which is rotatable as indicated by the arrow 13 about a rotational axis A1. The drying cylinder 12 defines a peripheral surface 14 for supporting the web W. An upstream roll 16 cooperates with the peripheral surface 14 of the drying cylinder 12, the upstream roll 16 being rotatable about an axis of rotation A2. The axis of rotation A2 is disposed spaced and parallel relative to the rotational axis A1 of the drying cylinder 12. A looped felt 18 extends around the upstream roll 16 and is guided by the upstream roll 16 so that the looped felt 18 and the peripheral surface 14 of the drying cylinder 12 define therebetween a nip N1 for the passage therethrough of the web W. The looped felt 18 moves away from the peripheral surface 14 of the drying cylinder 12 downstream relative to the nip N1 such that the web W inherently follows and is supported by the peripheral surface 14 of the drying cylinder 12 downstream relative to the nip N1. A shoe press generally designated 20 is disposed downstream relative to the nip N1. The shoe press 20 includes a shoe 22 which cooperates with the peripheral surface 14 of the drying cylinder 12 downstream relative to the nip N1. The arrangement is such that the shoe 22 and the peripheral surface 14 of the drying cylinder 12 define therebetween an extended nip N2 for the passage therethrough of the web W supported and guided by the peripheral surface 14 of the drying cylinder 12. A looped press felt 24 extends through the extended nip N2 such that the web W is disposed between the press felt 24 and the peripheral surface 14 of the drying cylinder 12 during passage of the web W through the extended nip N2.

In a more specific embodiment of the present invention, the drying cylinder 12 is a Yankee dryer.

Figure 2:
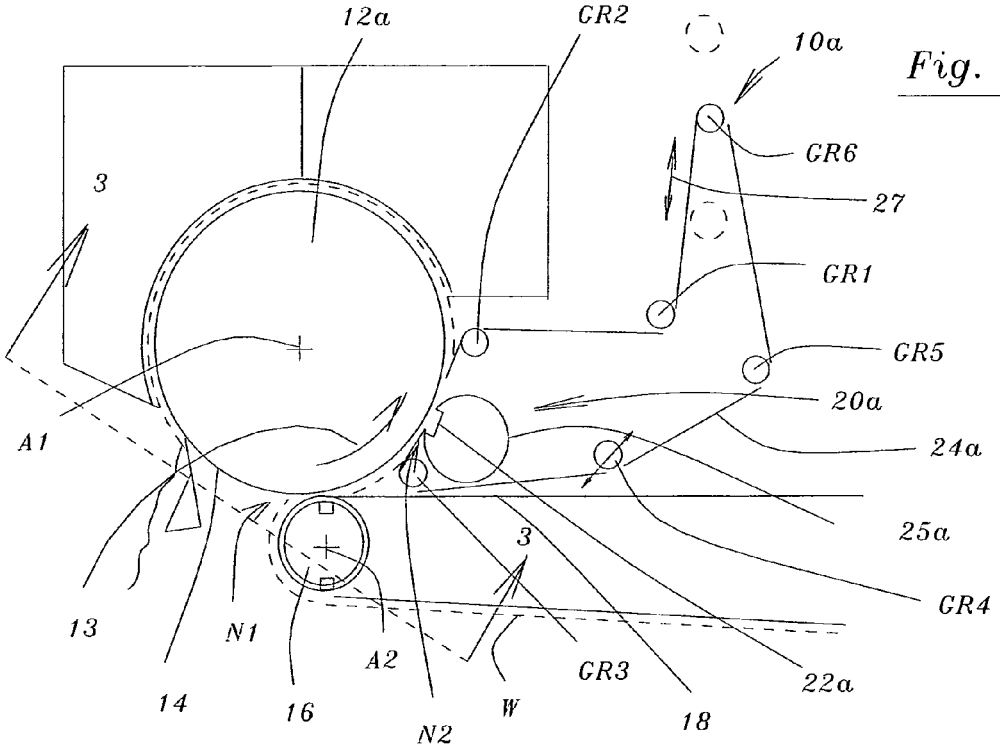
FIG. 2 is a side elevational view of another embodiment of the present invention.

FIG. 2 is a side elevational view of another embodiment of the present invention. As shown in FIG. 2, the drying apparatus 10*a* includes a drying cylinder 12*a* which is a through dryer.

Additionally, and particularly with regard to the embodiment shown in FIG. 1, the peripheral surface 14 of the drying cylinder or Yankee dryer, is a heated smooth surface.

Figure 3:
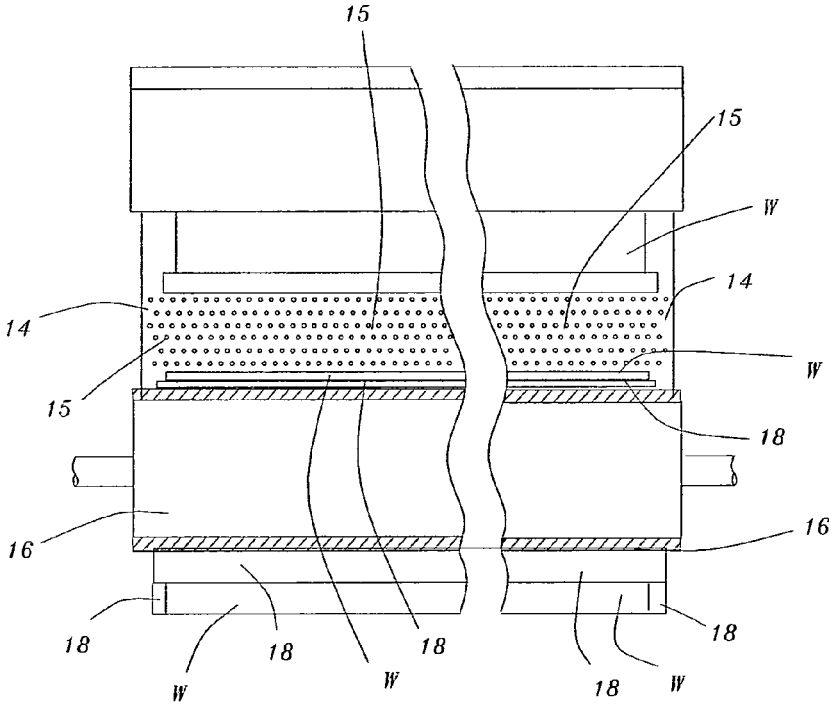
FIG. 3 is a view taken on the line 3-3 of FIG. 2.

FIG. 3 is a view taken on the line 3-3 of FIG. 2. As shown in FIG. 3, the peripheral surface 14*a* defines a plurality of perforations 15.

In both of the embodiments shown in FIGS. 1 and 2 respectively, the upstream roll 16 is a suction roll and the looped felt 18 guides the web W to and around the upstream roll 16.

Furthermore, the peripheral surface 14 guides and supports the web W during movement of the web from the nip N1 to the extended nip N2.

In the embodiments shown in FIGS. 1 and 2, the shoe 22 and 22*a* is a hydrodynamic shoe.

Figure 4:
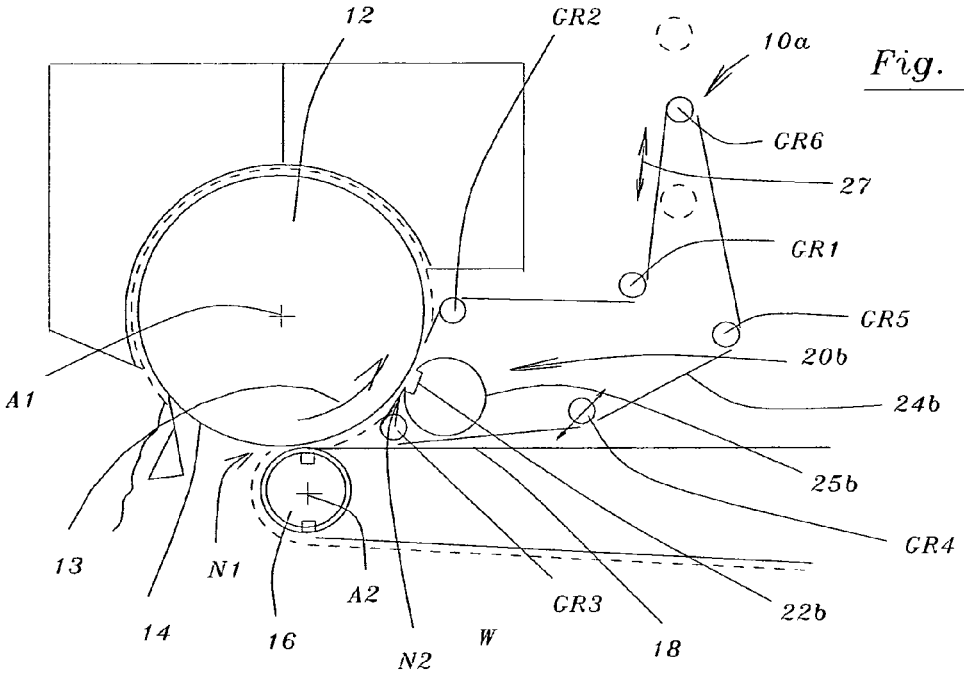
FIG. 4 is a side elevational view of yet another embodiment of the present invention.

FIG. 4 is a side elevational view of yet another embodiment of the present invention. As shown in FIG. 4, the shoe 22*b* is a hydrostatic shoe.

In all of the embodiments shown in FIGS. 1, 2 and 4, the shoe press 20, 20*a* and 20*b* respectively, further includes a blanket 25, 25*a* and 25*b* which slidably cooperates with the shoe 22, 22*a* and 22*b* respectively for supporting and guiding the press felt 24, 24*a* and 24*b* respectively during passage thereof through the extended nip 20, 20*a* and 20*b* respectively.

In a preferred embodiment of the present invention, the blanket 25, 25*a* and 25*b* is an enclosed blanket for enclosing the shoe 22, 22*a* and 22*b* respectively.

Also, the shoe press 20, 20*a* and 20*b* further include a plurality of guide rolls GR1, GR2, GR3, GR4, GR5 and GR6 for guiding the looped press felt 24, 24*a* and 24*b*.

At least one of the guide rolls GR1 to GR6 such as guide roll GR6 is movable as indicated by the arrow 27 so that tensioning of the press felt 24, 24*a* and 24*b* is permitted.

Also, an automatic press felt guiding device cooperates with at least one of the guide rolls so that the press felt is guided during running of the press felt.

Additionally, at least one of the guide rolls is a driven roll so that the press felt loop is driven when the shoe is disposed in an open nip condition.

In operation of the drying apparatus 10, the web W supported by the felt 18 is guided around the upstream roll 16 so that the web W extends through the nip N1. The peripheral surface 14 in the case of a heated dryer or Yankee dryer is heated. Therefore, when the web W exits from the nip N1, the web W will inherently follow the heated peripheral surface 14 of the drying cylinder 12 rather than follow the felt 18. Accordingly, the web supported by the heated peripheral surface 14 will enter the extended nip N2. A relatively large amount of water will be pressed from the tissue web during passage thereof through the extended nip N2. Therefore, the present invention provides a unique configuration in that the press felt 24 is a different felt than the felt 18 extending through the nip N1. Accordingly, the water absorbing capacity of the press felt will not be compromised as would be the case if the press felt 24 were to extend through the nip N1 before extending through the extended nip N2.

The present invention provides a unique arrangement for enhancing the water removing capability of a shoe press that cooperates with a heated dryer.

What is claimed is:

1. In a papermaking machine, a dryer apparatus for drying a web, said dryer apparatus comprising:

a drying cylinder which is rotatable about a rotational axis, said drying cylinder defining a peripheral surface for supporting and drying the web;

an upstream roll cooperating with said peripheral surface of said drying cylinder, said upstream roll being rotatable about an axis of rotation, said axis of rotation being disposed spaced and parallel relative to said rotational axis of said drying cylinder;

a looped felt extending around said upstream roll and guided by said upstream roll so that said looped felt and said peripheral surface of said drying cylinder define therebetween a nip for the passage therethrough of the web, said looped felt moving away from said heated peripheral surface of said drying cylinder downstream relative to said nip such that the web inherently follows and is supported by said peripheral surface of said drying cylinder downstream relative to said nip;

a shoe press disposed downstream relative to said nip, said shoe press including:

a shoe which cooperates with said peripheral surface of said drying cylinder downstream relative to said nip such that said shoe and said peripheral surface of said drying cylinder define therebetween an extended nip for the passage therethrough of the web supported and guided by said peripheral surface of said drying cylinder; and a looped press felt extending through said extended nip such that the web is disposed between said press felt and said peripheral surface of said drying cylinder during passage of the web through said extended nip.

2. The dryer apparatus as set forth in claim 1 wherein said drying cylinder is a Yankee dryer.

3. The dryer apparatus as set forth in claim 1 wherein said drying cylinder is a through dryer.

4. The dryer apparatus as set forth in claim 1 wherein said peripheral surface is a heated smooth surface.

5. The dryer apparatus as set forth in claim 1 wherein said peripheral surface defines a plurality of perforations.

6. The dryer apparatus as set forth in claim 1 wherein said upstream roll is a suction roll.

7. The dryer apparatus as set forth in claim 1 wherein said looped felt guides the web to and around said upstream roll.

8. The dryer apparatus as set forth in claim 1 wherein said peripheral surface guides and supports the web during movement of the web from said nip to said extended nip.

9. The dryer apparatus as set forth in claim 1 wherein said shoe is a hydrodynamic shoe.

10. The dryer apparatus as set forth in claim 1 wherein said shoe is a hydrostatic shoe.

11. The dryer apparatus as set forth in claim 1 wherein said shoe press further includes:

a blanket which slidably cooperates with said shoe for supporting and guiding said press felt during passage thereof through said extended nip.

12. The dryer apparatus as set forth in claim 11 wherein said blanket is an enclosed blanket for enclosing said shoe.

13. The dryer apparatus as set forth in claim 1 wherein said shoe press further includes:

a plurality of guide rolls for guiding said looped press felt.

14. The dryer apparatus as set forth in claim 13 wherein at least one of said guide rolls is movable so that tensioning of said press felt is permitted.

15. The dryer apparatus as set forth in claim 13 further including:

an automatic press felt guiding device cooperating with at least one of said guide rolls so that said press felt is guided during running of said press felt.

16. The dryer apparatus as set forth in claim 13 wherein at least one of said guide rolls is a driven roll so that said press felt loop is driven when said shoe is disposed in an open nip condition.

17. In a papermaking machine, a dryer apparatus for drying a tissue web, said dryer apparatus comprising:

a drying cylinder which is rotatable about a rotational axis, said drying cylinder defining a heated peripheral surface for supporting and drying the web;

an upstream roll cooperating with said heated peripheral surface of said drying cylinder, said upstream roll being rotatable about an axis of rotation, said axis of rotation being disposed spaced and parallel relative to said rotational axis of said drying cylinder;

a looped felt extending around said upstream roll and guided by said upstream roll so that said looped felt and said heated peripheral surface of said drying cylinder define therebetween a nip for the passage therethrough of the web, said looped felt moving away from said heated peripheral surface of said drying cylinder downstream relative to said nip such that the web inherently follows and is supported by said heated peripheral surface of said drying cylinder downstream relative to said nip;

a shoe press disposed downstream relative to said nip, said shoe press including:

a shoe which cooperates with said heated peripheral surface of said drying cylinder downstream relative to said nip such that said shoe and said heated peripheral surface of said drying cylinder define therebetween an extended nip for the passage therethrough of the web supported and guided by said heated peripheral surface of said drying cylinder;

a looped press felt extending through said extended nip such that the web is disposed between said press felt and said heated peripheral surface of said drying cylinder during passage of the web through said extended nip; and said heated peripheral surface guides and supports the web during movement of the web from said nip to said extended nip.

18. In a papermaking machine, a dryer apparatus for drying a web, said dryer apparatus comprising:

a drying cylinder which is rotatable about a rotational axis, said drying cylinder defining a heated peripheral surface for supporting and drying the web;

an upstream roll cooperating with said heated peripheral surface of said drying cylinder, said upstream roll being rotatable about an axis of rotation, said axis of rotation being disposed spaced and parallel relative to said rotational axis of said drying cylinder;

a looped felt extending around said upstream roll and guided by said upstream roll so that said looped felt and said heated peripheral surface of said drying cylinder define therebetween a nip for the passage therethrough of the web, said looped felt moving away from said heated peripheral surface of said drying cylinder downstream relative to said nip such that the web inherently follows and is supported by said heated peripheral surface of said drying cylinder downstream relative to said nip;

a shoe press disposed downstream relative to said nip, said shoe press including:

a shoe which cooperates with said heated peripheral surface of said drying cylinder downstream relative to said nip such that said shoe and said heated peripheral surface of said drying cylinder define therebetween an extended nip for the passage therethrough of the web supported and guided by said heated peripheral surface of said drying cylinder;

a looped press felt extending through said extended nip such that the web is disposed between said press felt and said heated peripheral surface of said drying cylinder during passage of the web through said extended nip;

said drying cylinder is a through dryer;

said heated peripheral surface defines a plurality of perforations;

said upstream roll is a suction roll;

said looped felt guides the web to and around said upstream roll;

said heated peripheral surface guides and supports the web during movement of the web from said nip to said extended nip;

said shoe is a hydrodynamic shoe;

said shoe press further includes:

a blanket which slidably cooperates with said shoe for supporting and guiding said press felt during passage thereof through said extended nip;

said blanket being an enclosed blanket for enclosing said shoe;

said shoe press further includes:

a plurality of guide rolls for guiding said looped press felt;

at least one of said guide rolls is movable so that tensioning of said press felt is permitted;

an automatic guiding system cooperating with at least one of said guide rolls so that said press felt is guided by said guiding system; and at least one of said guide rolls being driven so that said press felt is driven when said extended nip is disposed in an open nip condition.

* * * * *